US008066738B2

(12) United States Patent
Kliegman et al.

(10) Patent No.: US 8,066,738 B2
(45) Date of Patent: Nov. 29, 2011

(54) PACIFIER

(75) Inventors: Adriana B. Kliegman, New York, NY (US); Diana B. Sierra, North Bergen, NJ (US)

(73) Assignee: Playtex Products, Inc., Westport, CT (US)

( * ) Notice: Subject to any disclaimer, the term of this patent is extended or adjusted under 35 U.S.C. 154(b) by 401 days.

(21) Appl. No.: 12/080,047

(22) Filed: Mar. 31, 2008

(65) Prior Publication Data

US 2009/0248074 A1 Oct. 1, 2009

(51) Int. Cl.
*A61J 17/00* (2006.01)

(52) U.S. Cl. ..... 606/234

(58) Field of Classification Search ..... None
See application file for complete search history.

(56) References Cited

U.S. PATENT DOCUMENTS

| | | | | |
|---|---|---|---|---|
| 3,022,915 | A | 2/1962 | Mullin | 515/11.1 |
| 3,653,386 | A | 4/1972 | Jacobus | 606/236 |
| 3,825,014 | A | 7/1974 | Wroten | 128/360 |
| 3,886,949 | A | 6/1975 | Hurst et al. | 128/360 |
| 4,143,452 | A | 3/1979 | Hakim | 29/434 |
| 4,329,996 | A | 5/1982 | Copeland | 606/234 |
| D267,116 | S | 11/1982 | Bubelis | D24/194 |
| 4,381,785 | A | 5/1983 | Robbins | 606/236 |
| 4,545,378 | A | 10/1985 | Chrones | 128/360 |
| 4,577,632 | A | 3/1986 | Grasset | 606/236 |
| 4,640,282 | A | 2/1987 | Careborg | 606/234 |
| 4,852,569 | A | 8/1989 | Sanders | 606/234 |
| 4,856,519 | A | 8/1989 | Teves | 606/234 |
| D303,839 | S | 10/1989 | Fitzpatrick et al. | D24/194 |
| 4,909,253 | A | 3/1990 | Cook et al. | 606/234 |
| D326,919 | S | 6/1992 | Geitner et al. | D24/194 |
| 5,133,740 | A | 7/1992 | Kussick | 606/236 |
| D334,064 | S | 3/1993 | Fitzpatrick | D24/194 |
| 5,275,619 | A | 1/1994 | Engebretson et al. | 606/236 |
| 5,334,218 | A | 8/1994 | Johnson | 606/235 |
| 5,403,349 | A | 4/1995 | Rohrig | 606/234 |
| 5,476,881 | A | 12/1995 | Suh | 523/122 |
| D380,836 | S | 7/1997 | Fitzpatrick et al. | D24/194 |
| 5,653,731 | A | 8/1997 | Rohrig | 606/234 |
| 5,658,314 | A | 8/1997 | Scheffer et al. | 606/235 |
| 5,688,238 | A | 11/1997 | Moser et al. | 604/77 |
| 5,759,195 | A * | 6/1998 | Fields et al. | 606/236 |

(Continued)

FOREIGN PATENT DOCUMENTS

DE 3316824 A1 11/1984

(Continued)

OTHER PUBLICATIONS

International Search Report dated May 12, 2009 for Application No. PCT/US09/01867.

(Continued)

*Primary Examiner* — Gary Jackson
*Assistant Examiner* — Christopher Schubert
(74) *Attorney, Agent, or Firm* — Ohlandt, Greeley, Ruggiero & Perle, LLP

(57) ABSTRACT

A pacifier includes an inner substrate layer and an outer substrate layer comolded over the inner substrate layer. The outer substrate layer forms a nipple and a handle. The inner substrate layer has a first portion covered by the outer substrate layer and a portion uncovered by the outer substrate layer forming a shield portion.

16 Claims, 9 Drawing Sheets

U.S. PATENT DOCUMENTS

| | | | | |
|---|---|---|---|---|
| D404,137 | S | 1/1999 | Underwood et al. | D24/194 |
| 5,868,131 | A | 2/1999 | Murchie | 128/204.13 |
| D409,309 | S | 5/1999 | Tollman | D24/194 |
| D413,387 | S | 8/1999 | Fitzpatrick et al. | D24/194 |
| 6,032,810 | A | 3/2000 | Meyers et al. | 215/11.1 |
| 6,056,774 | A | 5/2000 | Johansen et al. | 606/234 |
| 6,110,193 | A | 8/2000 | Chen | 606/234 |
| 6,241,110 | B1 | 6/2001 | Hakim | 215/11.1 |
| D450,126 | S | 11/2001 | Fitzpatrick et al. | D24/194 |
| 6,447,536 | B1 | 9/2002 | Hinshaw | 606/235 |
| 6,517,567 | B2 | 2/2003 | Bass, Jr. et al. | 606/234 |
| 6,575,999 | B1 | 6/2003 | Rohrig | 606/234 |
| 6,695,869 | B2 | 2/2004 | Fitzpatrick et al. | 606/234 |
| 6,905,507 | B2 | 6/2005 | Hinshaw | 606/235 |
| 7,029,491 | B2 | 4/2006 | Davis | 606/234 |
| 7,285,127 | B2 | 10/2007 | Jewett | 606/234 |
| D559,391 | S | 1/2008 | Kliegman et al. | D24/194 |
| 2003/0100922 | A1* | 5/2003 | Fitzpatrick et al. | 606/234 |
| 2004/0230017 | A1* | 11/2004 | Kerns et al. | 526/185 |
| 2006/0265013 | A1 | 11/2006 | Holley | 606/234 |
| 2007/0060873 | A1* | 3/2007 | Hiraoka et al. | 604/74 |

FOREIGN PATENT DOCUMENTS

| | | | |
|---|---|---|---|
| DE | 3347876 | A1 | 5/1985 |
| EP | 0381076 | | 8/1990 |
| EP | 01158949 | | 12/2001 |
| EP | 1240886 | A1 | 9/2006 |
| WO | WO 94/23686 | | 10/1994 |
| WO | WO 00/10505 | | 3/2000 |
| WO | WO 2006/098903 | | 9/2006 |

OTHER PUBLICATIONS

Written Opinion of International Searching Authority dated May 12, 2009 for Application No. PCT/US09/01867.

Evenflo Pacifiers, Mimi Neo One-Piece Pacifiers; Prodcuct List, Evenflo.com, 2006.

U.S. Appl. No. 29/272,644, filed Feb. 13, 2007, Kliegman et al.

U.S. Appl. No. 29/259,285, filed May 5, 2006, Kliegman.

* cited by examiner

FIG. 11
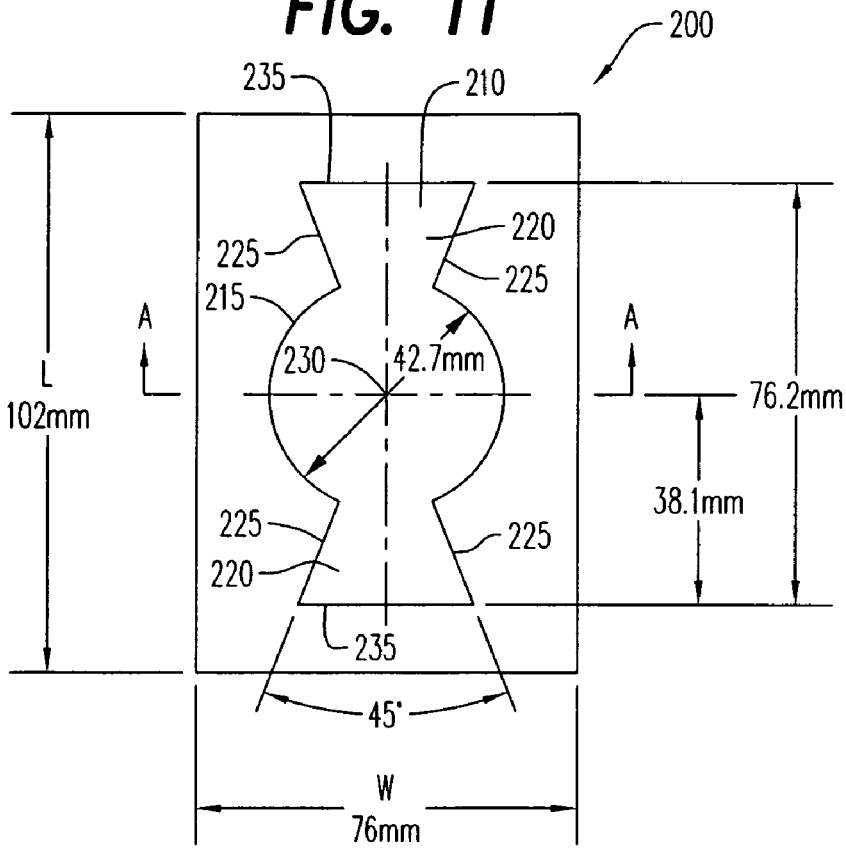
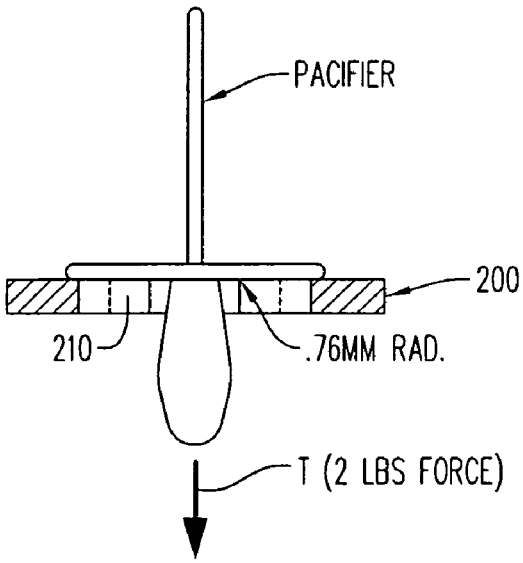
FIG. 12

PACIFIER

BACKGROUND OF THE INVENTION

1. Field of the Invention

This disclosure relates to pacifiers having at least two layers comolded together. More particularly, this disclosure provides for such a pacifier in which a portion of the inner layer is an outer surface of the pacifier.

2. Description of the Related Art

Traditional pacifiers are made up of a shield, a nipple, a handle and a nub. Pacifiers having a shield, a nipple, a handle and a nub require assembly. The assembly forms gaps where saliva, particles, and the like can accumulate and become unsanitary and difficult to clean.

Other one-piece pacifiers made of flexible materials have shields that must be a large size to pass safety standards. However, the large size is undesirable for babies.

Accordingly, there is a need to provide a comolded pacifier including flexible material safely sized for babies. There is a further need for a pacifier having a shape that increases manufacturing efficiency and ease of cleaning.

SUMMARY OF THE INVENTION

The present disclosure provides a pacifier having at least two layers that are comolded together.

The present disclosure further provides that such a comolded pacifier has a substantial portion of the inner layer exposed.

The above-described and other advantages and benefits of the present disclosure will be appreciated and understood by those skilled in the art from the following detailed description, drawings, and appended claims.

BRIEF DESCRIPTION OF THE DRAWINGS

FIG. 11 is a test fixture having an opening; and

FIG. 12 is a cross-sectional view taken along line A-A of FIG. 11.

DETAILED DESCRIPTION OF THE INVENTION

Figure 1:
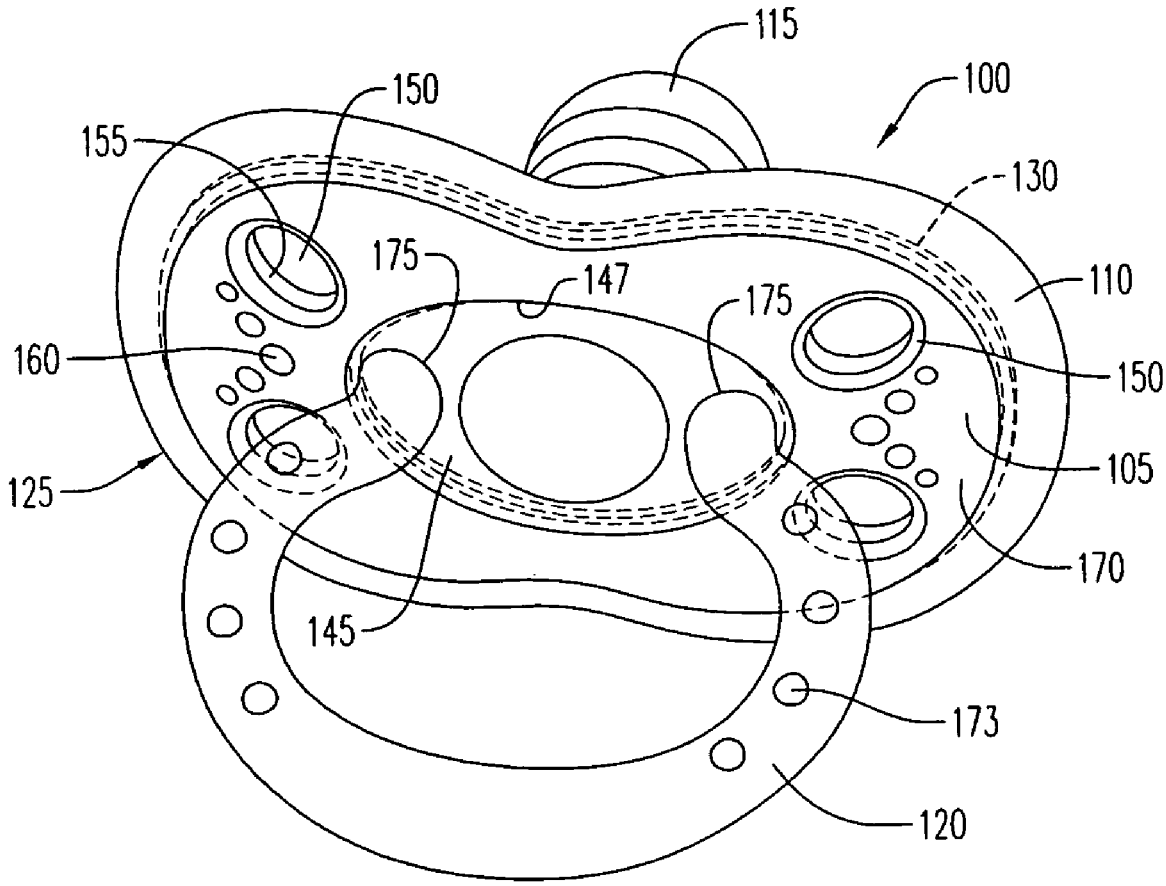
FIG. 1 is a bottom perspective view of a pacifier of the present disclosure.

Referring to the drawings and, in particular, to FIG. 1, an exemplary embodiment of a pacifier is generally represented by reference numeral 100. Pacifier 100 has an inner substrate layer 105 and an outer substrate layer 110. The outer substrate layer 110 is overmolded onto inner substrate layer 105 to form a nipple 115, a handle 120, and a shield portion 125. It is important to note that the inner substrate layer 105 and a portion of outer substrate layer 110 form a shield portion 125.

Figure 2:
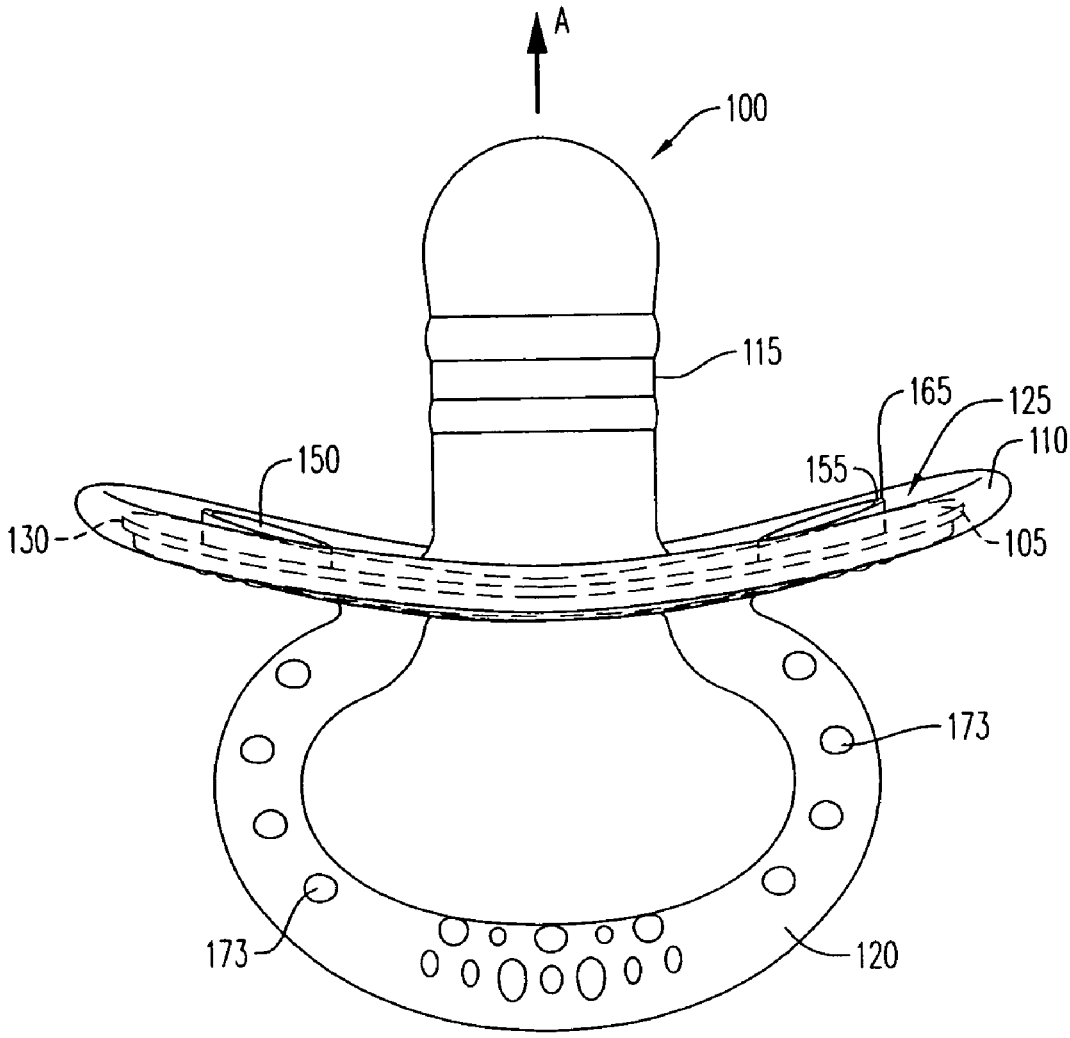
FIG. 2 is a front view of FIG. 1.
Figure 3:
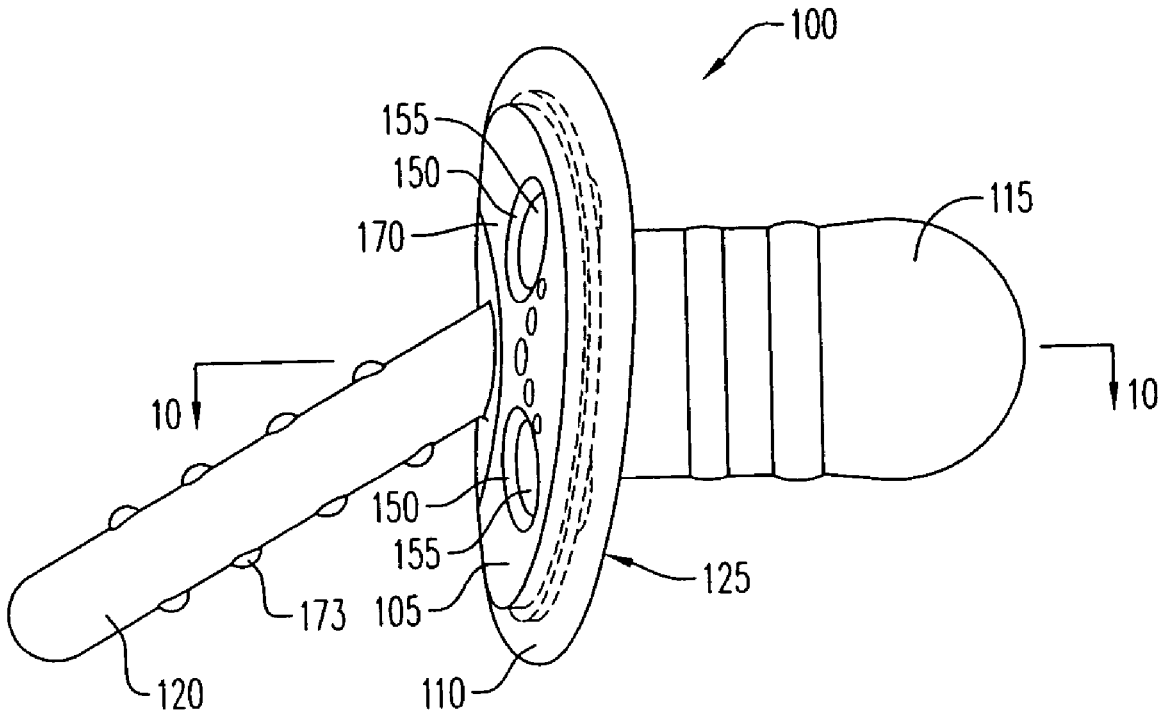
FIG. 3 is a side view of FIG. 1.

Referring now to FIGS. 2 through 3, outer substrate layer 110 is overmolded onto inner substrate layer 105 so that the outer substrate layer covers the side of pacifier 100 having nipple 115 formed thereon. The inner substrate layer 105 has a plurality of secondary holes 150 therethrough each with a sidewall 155. The outer substrate layer 110 abuts sidewall 155. The sidewall 155 may have an outer portion or lip 165 that is not covered by outer substrate layer 110, as shown in FIG. 2.

Figure 4:
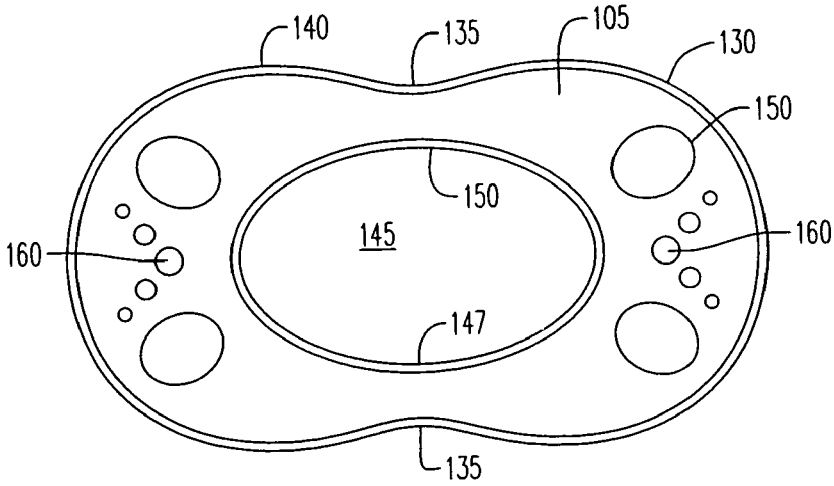
FIG. 4 is a bottom view of an inner substrate layer of the pacifier of FIG. 1.
Figure 5:
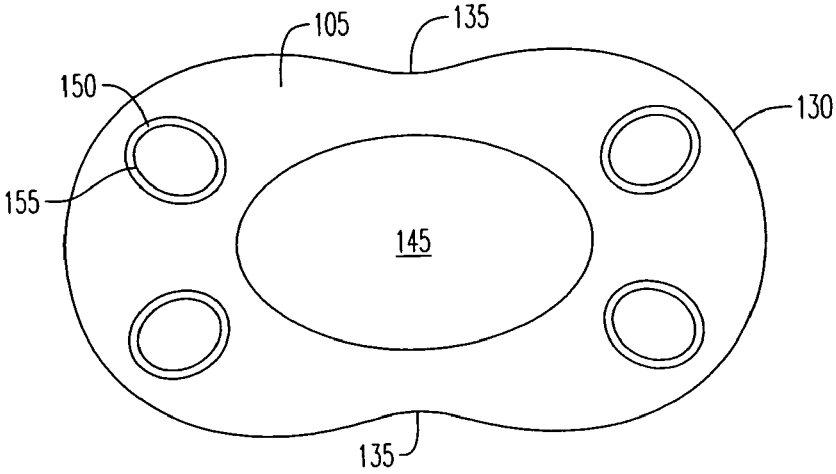
FIG. 5 is a top view of the inner substrate layer of FIG. 1.
Figure 6:
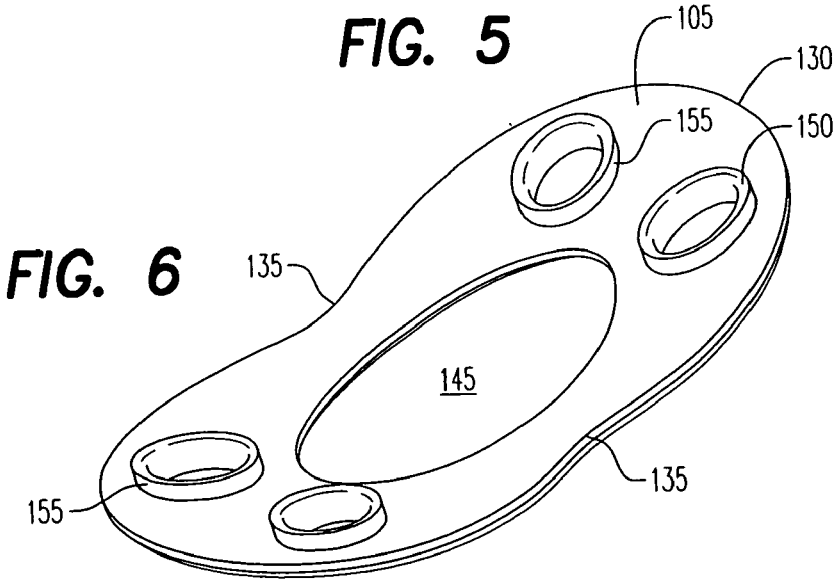
FIG. 6 is a top perspective view of the inner substrate layer of FIG. 1.
Figure 7:
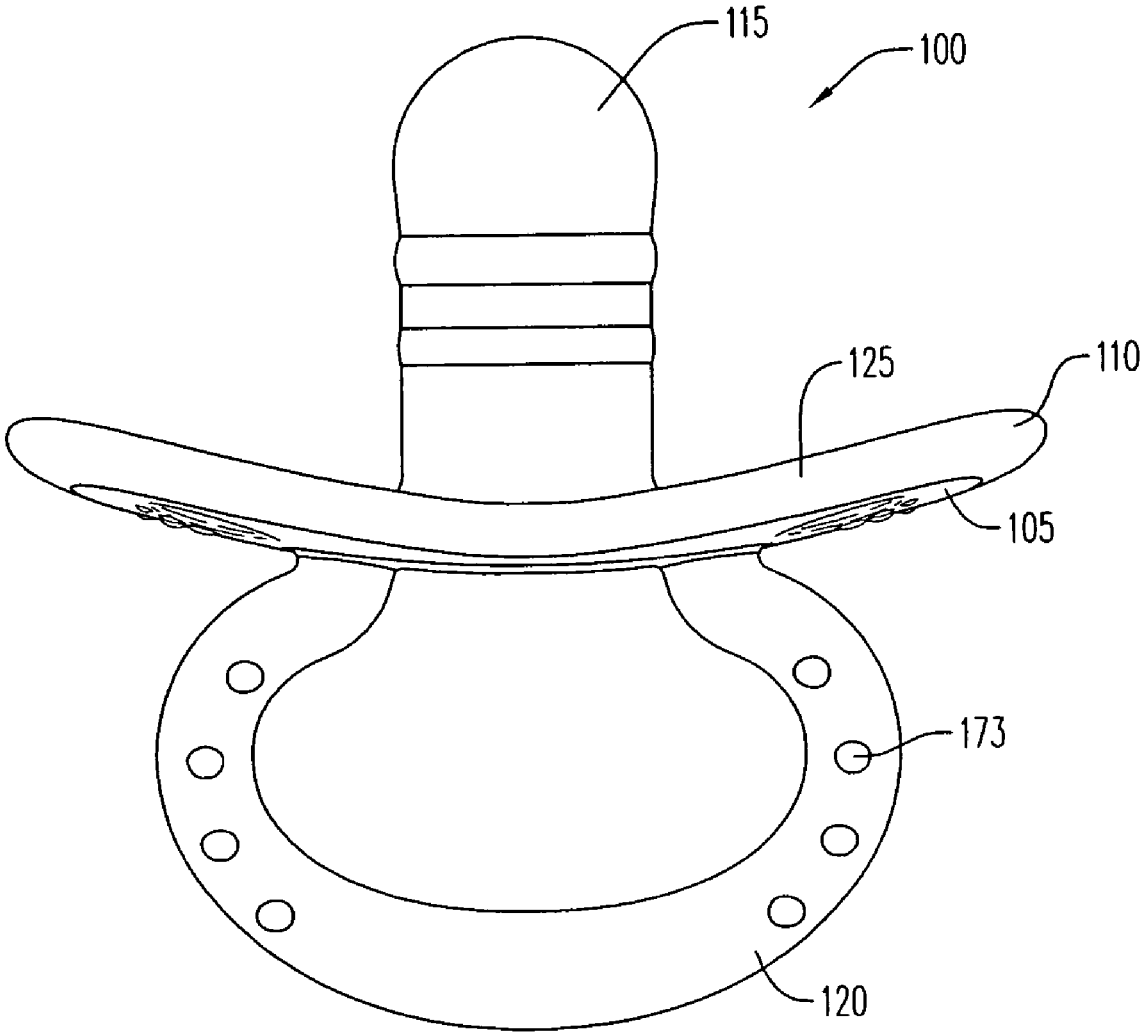
FIG. 7 is a rear view of FIG. 1.

Referring now to FIGS. 4 through 6, inner substrate layer 105 has an outer perimeter 130 with an oval shape having opposing recesses 135. The inner substrate layer 105 may be curved in a direction of nipple 115 of pacifier 100. The outer perimeter 130 has an outer edge 140 on a side of inner substrate layer 105 that faces handle 120 of pacifier 100. The outer edge 140 has a thickness that is less than at least a portion of inner substrate layer 105 adjacent outer edge 140. Within outer perimeter 130, inner substrate layer 105 has an inner hole 145 having an inner perimeter 147. Inner hole 145 has an inner edge 150 on the side of inner substrate layer 105 that faces handle 120 of pacifier 100. The inner edge 150 has a thickness that is less than at least a portion of inner substrate layer 105 adjacent the inner edge. The side of pacifier 100 having handle 120 may also include one or more protuberances 160 on inner substrate layer 105. The protuberances 160 may assist an infant in gripping pacifier 100 or provide him/her with a differentiated texture for stimulation. The protuberances can be in any pattern, however the pattern is preferably the arrowhead pattern shown in FIG. 4.

The inner substrate layer 105 has plurality of secondary holes 150. Each secondary hole 150 has sidewall 155 on a side of inner substrate layer 105 of pacifier 100 having nipple 115. The sidewall 155 projects outward from inner substrate layer 105.

Figure 10:
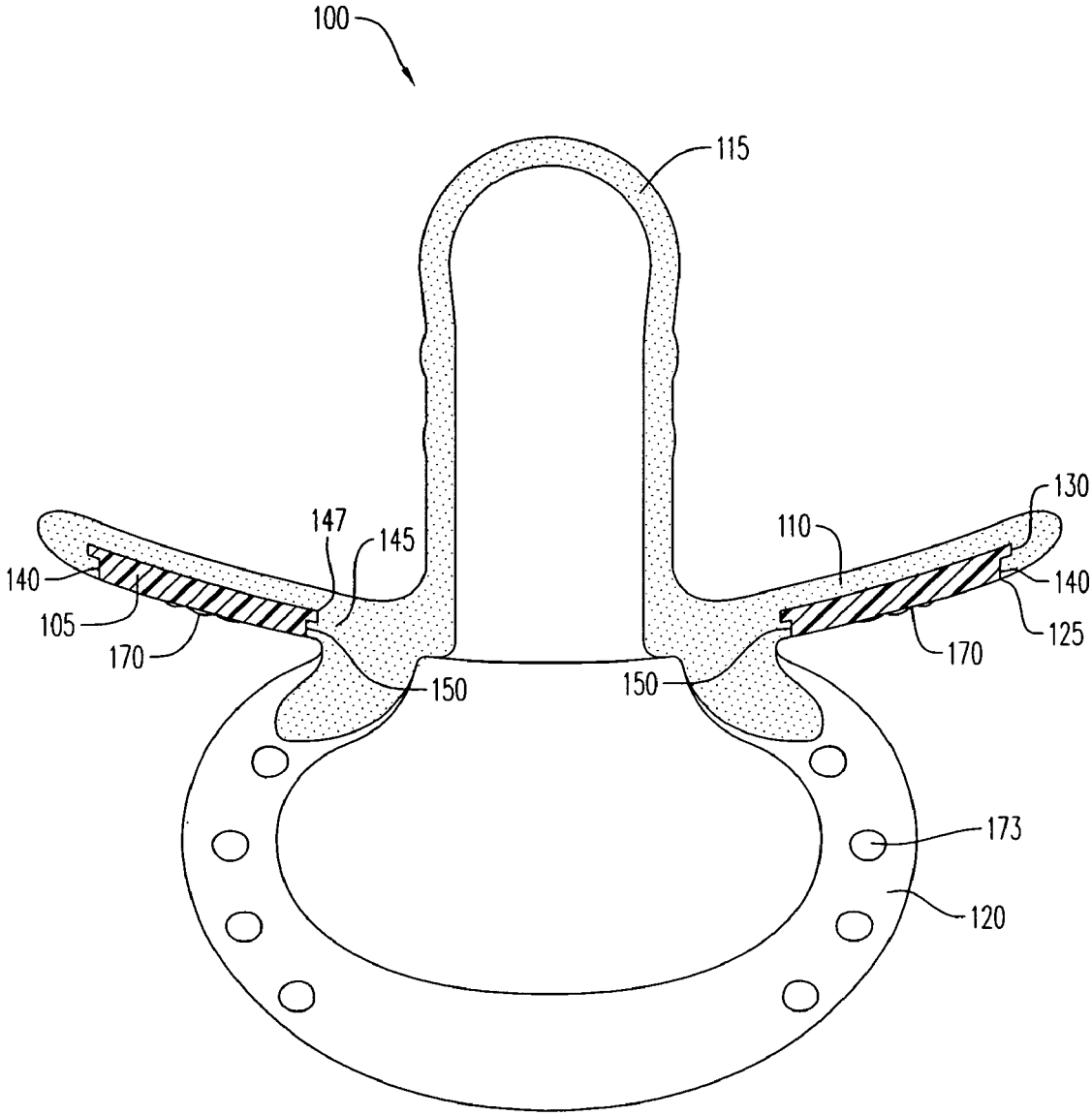
FIG. 10 is a cross-sectional view taken along line 10-10 of FIG. 3.

Referring to FIGS. 7 through 10, the outer substrate layer 110 extends around outer perimeter 130 and fills outer edge 140, as shown clearly in FIG. 10. The outer substrate layer 110 extends through inner hole 145 covering inner perimeter 147, filling inner edge 150. The outer substrate layer 110 may cover all of inner hole 145. A remaining portion 170 of inner substrate layer 105 on the side of pacifier 100 having handle 120 formed thereon is uncovered by outer substrate layer 110. Thus, shield portion 125 has a continuous surface without gaps where saliva, particles, and the like can accumulate that need to be accessed and cleaned.

The nipple 115 is formed by outer substrate layer 110 on a first side of shield portion 125. The nipple 115 extends away from shield portion 125 to be engaged by an infant. The nipple 115 may be hollow allowing the interior of nipple 115 to be cleaned. The nipple 115 may be formed entirely within inner perimeter 147. This allows for nipple 115 to flex during cleaning since a sizable portion around it is flexible. The nipple 115 may be, for example, cylindrical having one or more raised rings, or any other shape appropriate for suction by babies.

Referring to FIGS. 1 through 3 and 7 through 10, handle 120 is formed by outer substrate layer 110 on a second side of shield portion 125. The handle 120 extends away from shield portion 125 and may be gripped by a baby or adult. The handle 120 may have one or more bumps or protrusions 173. The handle 120 has two connection points 175 where the handle is molded so as to be connected to outer substrate layer 110 that forms shield portion 125, as shown in FIG. 1. The connection points 175 may be formed entirely within inner perimeter 147. This allows for minimal use of the more flexible material of outer substrate layer 110 which is usually more costly. The connection points 175 may be formed on a portion of outer substrate layer 110 outside of outer perimeter 130 on shield portion 125. This allows for a wider handle that can help with gripping. Connection points 175 may be coplanar with a connection between nipple 115 and shield portion 125.

Overmolding outer substrate layer 110 that encompasses nipple 115 and handle 120 around inner substrate layer 105 reduces a number of separate parts in pacifier 100. The handle 120 may extend in a bent position so that handle 120 is not perpendicular to shield portion 125, as shown in FIG. 3.

The shield portion 125 is sized to comply with U.S. requirements specified in 16 C.F.R. 1511 for Infant Pacifiers that is incorporated by reference herein. At least a portion of shield portion 125 does not go through a fixture that has an opening having dimensions and shape shown in FIG. 11 when a 2 pound tensile force T is applied to the center of the nipple as shown in FIG. 12 while the shield is centered. FIG. 11 shows a fixture 200 having a length dimension L of about 102 millimeters and a width dimension W about 76 millimeters and having a center opening 210. The center opening 210 is bowtie-shaped. The center opening has a circular portion 215 having a diameter of about 42.7 millimeters and side portions 220 on opposite sides thereof. Each side portion 220 has a pair of side legs 225 extending from circular portion 215 that form about a 45 degree angle with each other as measured from a center 230 of the circular portion. The side portions 220 each have an end leg 235 connecting each pair of side legs 230 that is about 38.1 millimeters from center 230 of circular portion 215. The force is applied gradually attaining but not exceeding a 2 pound force within a 5 second period and maintained for another 10 seconds. If the pacifier is pulled completely through the test opening during testing, the pacifier fails and does not comply with safety standards.

Figure 8:
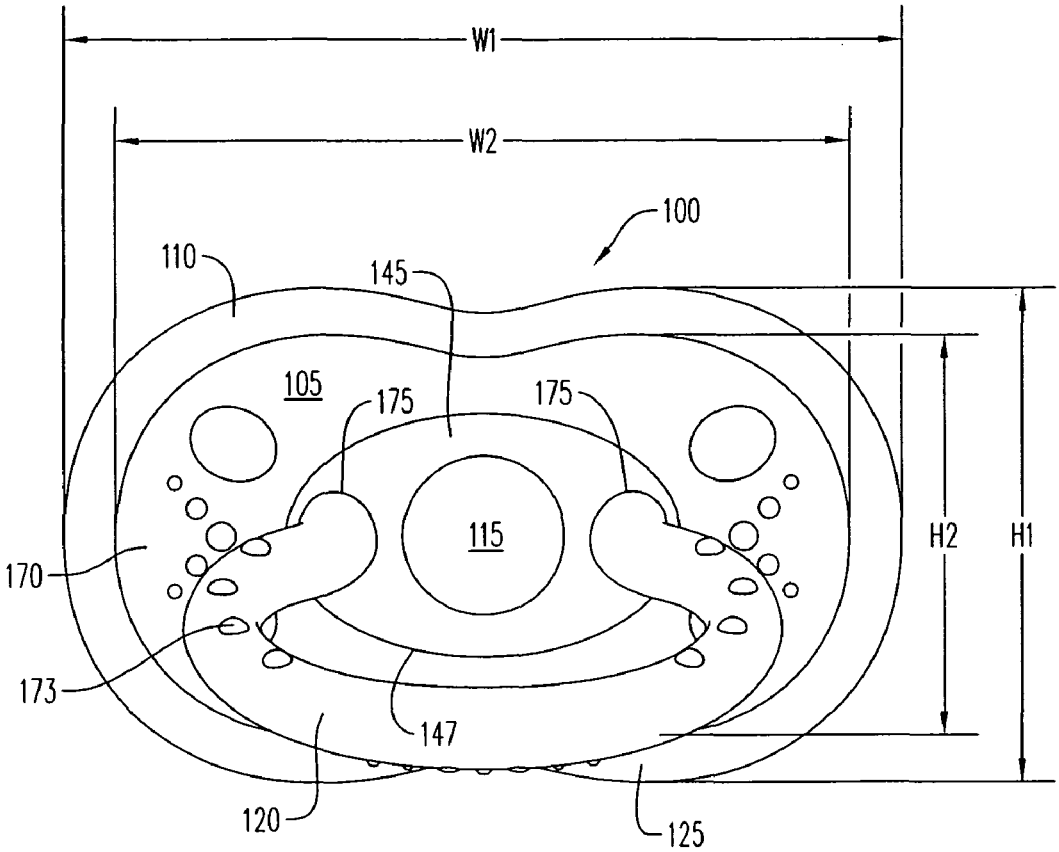
FIG. 8 is a bottom view of FIG. 1.
Figure 9:
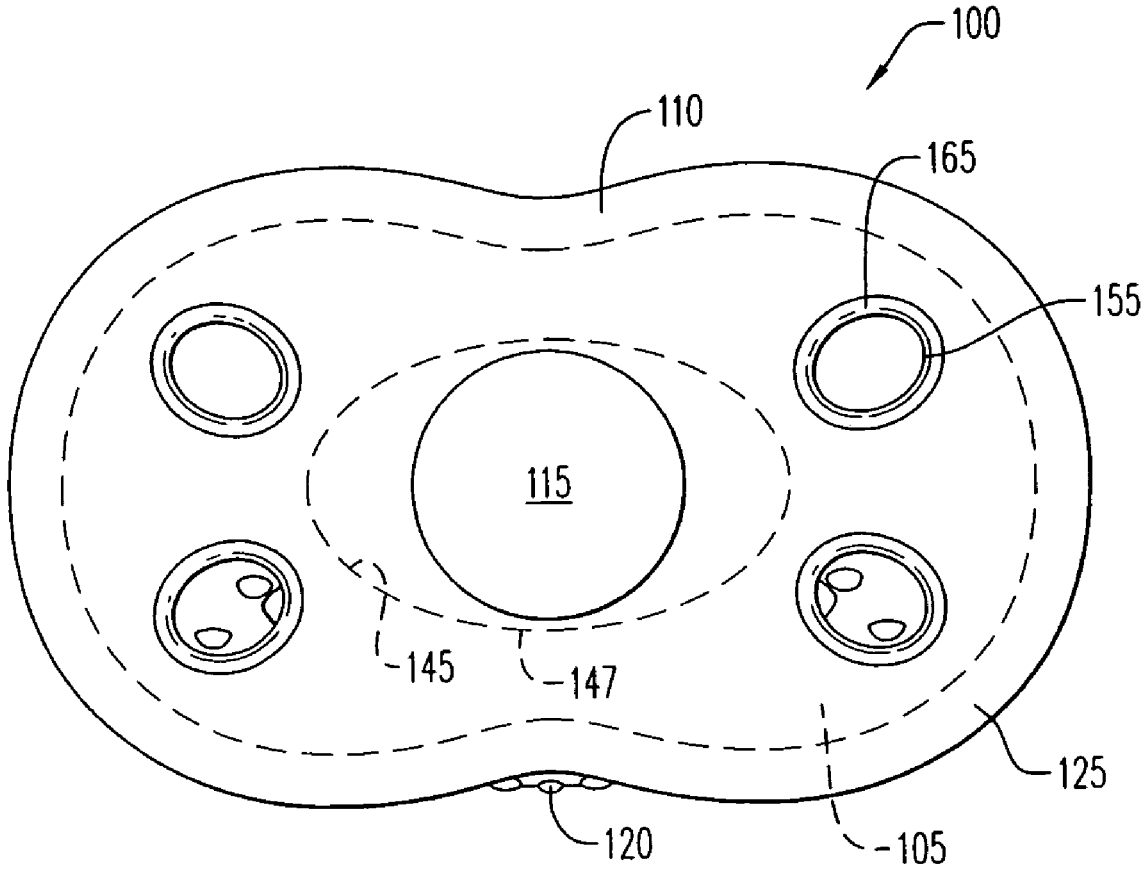
FIG. 9 is a top view of FIG. 1.

The shield portion 125 has a width W1 and a height H1, as shown in FIG. 8. The width W1 may be about 57.0 millimeters and height H1 may be about 34.5 millimeters. The shield portion 125 may have a thickness of about 2.8 millimeters. The inner substrate layer 105 may have a width W2 of about 50.0 millimeters and a height H2 of about 28.5 millimeters. The inner substrate layer 105 may have a thickness of about 1.5 millimeters. The pacifier 100 having the dimensions described above will comply or exceed the Infant Pacifier test set forth in 16 C.F.R. 1511.

The outer material layer 110 has more flexibility than the inner substrate layer 105. The outer substrate layer 110 may be silicone. For example, the silicone may be silicone marketed under the tradename LIM® 8040 that is a 2-component liquid injection molding material having a 1:1 mix ratio and cures rapidly at molding temperatures of 150 degrees Celsius to 190 degrees Celsius to a high tear strength, translucent silicone elastomer and has a specific gravity of about 1.08 gm/cc and a ShoreA hardness of about 43 to 46 durometers. The silicone may also be, for example, a silicone rubber having a 1:1 mix ratio having ShoreA hardness of about 67 durometers. The silicone has a grade that is compatible with a wide variety of thermoplastics for injection molding may be molded to inner substrate layer 105 to securely attach outer substrate layer 110 to inner substrate layer 105.

The inner substrate layer 105 may be, for example, Polyamide or nylon, Acrylonitrile Butadiene Styrene (ABS) or Polycarbonate (PC). For example, the nylon may be nylon marketed under the tradename Zytel® 101L NCO10 that is a lubricated molding grade PA 66 resin that has a yield stress of about 55 MegaPascals (MPa) to 82 MPa and a tensile modulus of about 3100 MPa to about 1400 MPa.

These types of silicone material that are compatible with thermoplastics for injection molding can be costly. The pacifier 100 disclosed herein limits the amount of silicone material used to make it cost effective. Materials such as thermoplastic elastomers have an odor that is detectable by babies resulting in pacifier rejection. The silicone has substantially no odor detectable by babies. The outer substrate layer 110 may have a durometer between about 40 to about 70 ShoreA. The inner substrate layer 105 may have a modulus of Elasticity between about 800 to about 1600 kilo-pounds per square inch (ksi).

Again referring to FIG. 10, the inner substrate layer 105 may be molded in a first mold and ejected from the first mold. The inner substrate layer 105 is inserted into a second mold where outer material layer 110 is comolded with inner substrate layer 105 to form a shield portion, a nipple, and a handle.

When a baby engages pacifier 100 and applies a sucking force inward as shown by arrow A in FIG. 2, outer substrate layer 110 applies a force on inner substrate layer 105 at outer edge 140 and inner edge 150 to reduce flexing of shield portion 125 while maintaining the connection between the inner substrate layer and the outer substrate layer. The inner substrate layer 105 reduces an amount of flexing over a shield portion 125 of the same size that comprises only material of outer substrate layer 110. Reducing shield portion 125 from flexing allows for a smaller shield than if shield portion 125 is only of a material layer of outer substrate layer 110 so that the shield portion may be a smaller size more appropriate for a baby. Outer substrate layer 110 maintains a desired softness to an infant's touch. The size and materials of pacifier 100 are more ergonomic and appropriately sized for baby than prior art pacifiers.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

We claim:

1. A pacifier comprising:

an inner substrate layer having a inner hole and an outer perimeter; and an outer substrate layer molded over said inner substrate layer, said outer substrate layer forming a shield section, a nipple and a handle, said inner substrate layer having a first portion covered by said shield section of said outer substrate layer and a second portion uncovered by said outer substrate layer, said shield section of said outer substrate layer, said first portion of said inner substrate layer, and said second portion of said inner substrate layer forming a shield portion, said first portion of said inner substrate layer being absent of holes between said inner hole and said outer perimeter, wherein said outer substrate layer applies a force on said inner substrate layer at said inner hole and said outer perimeter to reduce flexing of said shield portion during suction.

2. The pacifier of claim 1, wherein said inner substrate layer is rigid and said outer substrate is flexible.

3. The pacifier of claim 1, wherein said shield portion has a first side having said nipple and a second side having said handle, and wherein said inner substrate layer has a plurality of holes through said second portion that is uncovered by said outer substrate layer, and wherein said plurality of holes each extends from said first side to said second side through said outer substrate layer.

4. The pacifier of claim 1, wherein said inner hole has an inner perimeter that said inner substrate layer extends around, and wherein said nipple is connected to said shield portion entirely within said inner perimeter on a side of said shield portion.

5. The pacifier of claim 1, wherein said inner hole has an inner perimeter that said inner substrate layer extends around, and wherein said handle is connected to said shield portion entirely within said inner perimeter on a side of said shield portion opposite said nipple.

6. The pacifier of claim 1, wherein said shield portion and said handle are connected forming a first connection and said shield portion and said nipple are connected forming a second connection, and wherein said first connection and said second connection are coplanar.

7. The pacifier of claim 1, wherein said inner substrate layer is polyamide.

8. The pacifier of claim 1, wherein said outer substrate layer is silicone.

9. The pacifier of claim 8, wherein said silicone has substantially no odor.

10. The pacifier of claim 1, wherein said outer substrate layer is between about a 40 ShoreA durometer to about a 70 ShoreA durometer.

11. The pacifier of claim 1, wherein said inner substrate layer has a modulus of Elasticity between about 800 kilo-pounds per square inch to about 1600 kilo-pounds per square inch.

12. A pacifier comprising:

an inner substrate layer having an inner hole and an outer perimeter, said inner hole having an inner perimeter that said inner substrate layer extends around;

and an outer substrate layer comolded over said inner substrate layer to form a shield portion, a nipple, and a handle, and said handle being connected to said shield portion within said inner perimeter on a side of said shield portion, said inner substrate layer being absent of holes-between said inner hole and said outer perimeter where said outer substrate layer covers said inner substrate layer, wherein said outer substrate layer applies a force on said inner substrate layer at said inner hole and said outer perimeter to reduce flexing of said shield portion during suction.

13. The pacifier of claim 12, wherein said inner substrate layer is rigid and said outer substrate is flexible.

14. The pacifier of claim 12, wherein said shield portion has a first side having said nipple and a second side having said handle, wherein said inner substrate layer has a plurality of holes through a portion of said inner substrate layer is uncovered by said outer substrate layer, and wherein said plurality of holes each extends from said first side to said second side.

15. A method of making a pacifier comprising:

molding an inner substrate layer in a first mold, said inner substrate layer having an inner hole and an outer perimeter, ejecting said inner substrate layer from said first mold;

inserting said inner substrate layer into a second mold; and comolding said inner substrate layer with an outer substrate layer in said second mold to form a shield portion, a nipple, and a handle, said inner substrate layer being absent of holes between said inner hole and said outer perimeter where said outer substrate layer is comolded over said inner substrate layer, wherein said outer substrate layer applies a force on said inner substrate layer at said inner hole and said outer perimeter to reduce flexing of said shield portion during suction.

16. The method of claim 15, wherein said inner substrate layer has a first portion covered by a shield section of said outer substrate layer and a portion uncovered by said outer substrate layer forming said shield portion.

* * * * *